US009531084B2

(12) United States Patent
Li et al.

(10) Patent No.: US 9,531,084 B2
(45) Date of Patent: Dec. 27, 2016

(54) MULTIPLE INPUT MULTIPLE OUTPUT (MIMO) ANTENNAS HAVING POLARIZATION AND ANGLE DIVERSITY AND RELATED WIRELESS COMMUNICATIONS DEVICES

(75) Inventors: Hui Li, Stockholm (SE); Buon Kiong Lau, Lund (SE); Ying Zhinong, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 364 days.

(21) Appl. No.: 14/115,461

(22) PCT Filed: Jun. 30, 2011

(86) PCT No.: PCT/IB2011/001532

§ 371 (c)(1),
(2), (4) Date: Nov. 4, 2013

(87) PCT Pub. No.: WO2013/001327

PCT Pub. Date: Jan. 3, 2013

(65) Prior Publication Data

US 2014/0078010 A1 Mar. 20, 2014

(51) Int. Cl.
*H01Q 1/24* (2006.01)
*H01Q 21/00* (2006.01)
(Continued)

(52) U.S. Cl.
CPC ..... *H01Q 21/0075* (2013.01); *H01Q 1/243* (2013.01); *H01Q 1/521* (2013.01);
(Continued)

(58) Field of Classification Search
CPC ..... H01Q 1/243; H01Q 1/521; H01Q 7/005; H01Q 9/42; H01Q 21/0075
(Continued)

(56) References Cited

U.S. PATENT DOCUMENTS 5,422,650 A * 6/1995 Hill ..... H01Q 7/005 343/713
2006/0071864 A1* 4/2006 Richard ..... H01Q 1/242 343/702
(Continued)

FOREIGN PATENT DOCUMENTS

JP 2001 332930 A 11/2001
JP 2005 347958 A 12/2005
WO WO 2005/006579 A1 1/2005

OTHER PUBLICATIONS

Li et al., "Internal Penta-Band Printed Loop-Type Mobile Phone Antenna," Tencon 2007, 2007 IEEE Region 10 Conference, Oct. 30, 2007, pp. 1-4.
(Continued)

*Primary Examiner* — Dieu H Duong
(74) *Attorney, Agent, or Firm* — Myers Bigel, P.A.

(57) ABSTRACT

Antenna systems are provided including a chassi and first and second radiating elements coupled to the chassi. The first radiating element is configured to amplify excitation of the chassi and the second radiating element is configured to reduce excitation of the chassi so as to reduce mutual coupling in the antenna system. Related co-located antennas and methods of controlling mutual coupling are also provided.

16 Claims, 6 Drawing Sheets

(51) Int. Cl.

| | |
|---|---|
| ***H01Q 1/52*** | (2006.01) |
| ***H01Q 7/00*** | (2006.01) |
| ***H01Q 9/42*** | (2006.01) |
| ***H01Q 21/28*** | (2006.01) |

(52) U.S. Cl.
CPC ..... *H01Q 7/005* (2013.01); *H01Q 9/42* (2013.01); *H01Q 21/28* (2013.01)

(58) Field of Classification Search
USPC ..... 343/702, 729, 728, 748, 866
See application file for complete search history.

(56) References Cited

U.S. PATENT DOCUMENTS

| | | | |
|---|---|---|---|
| 2009/0009401 | A1 | 1/2009 | Suzuki et al. |
| 2009/0140946 | A1 | 6/2009 | Ziolkowski et al. |

OTHER PUBLICATIONS

Li et al., "Optimal Multiple Antenna Design for Compact MIMO Terminals with Ground Plane Excitation," 2011 International Workshop on Antenna Technology (IWAT), Mar. 7, 2011, pp. 218-221.

Notification of Transmittal of the International Search Report and the Written Opinion of the International Searching Authority, or the Declaration, PCT/IB2011/001532, Mar. 21, 2012.

Jensen et al., "A Review of Antennas and Propagation for MIMO Wireless Communications," IEEE Transactions on Antennas and Propagation, vol. 52, No. 11, Nov. 2004, pp. 2810-2824.

Lau, Buon Kiong, Chapter 10, Multiple Antenna Terminals of "MIMO: From Theory to Implementation," Editors Oestges et al, Academic Press, 2011, pp. 267-298.

Diallo et al., "Enhanced two-antenna structures for universal mobile telecommunications system diversity terminals," IET Microw. Antennas Propogat., vol. 2, No. 1, 2008, pp. 93-101.

Li et al., "A Compact Planar MIMO Antenna System for Four Elements With Similar Radiation Characteristics and Isolation Structure," IEEE Antennas and Wireless Propagation Letters, vol. 1, 2009, pp. 1107-1110.

Harrington et al., "Computation of Characteristic Modes for Conducting Bodies," IEEE Transactions on Antennas and Propagation, vol. AP-19, No. 5, Sep. 1971, pp. 629-639.

Erentok et al, "Metamaterial-Inspired Efficient Electrically Small Antennas," IEEE Transactions on Antennas and Propagation, vol. 56, No. 3, Mar. 2008, pp. 691-706.

* cited by examiner

MULTIPLE INPUT MULTIPLE OUTPUT (MIMO) ANTENNAS HAVING POLARIZATION AND ANGLE DIVERSITY AND RELATED WIRELESS COMMUNICATIONS DEVICES

CROSS-REFERENCE TO RELATED APPLICATION

This application is a 35 U.S.C. §371 national stage application of PCT International Application No, PCT/IB2011/001532, filed on Jun. 30, 2011, the disclosure and contents of which are incorporated by reference herein as if set forth in Its entirety. The above-referenced PCT International Application was published in the English language as International Publication No. WO2013/001327 on Jan. 3, 2013.

FIELD

The present application relates generally to communication devices, and more particularly to, multiple-input multiple-output (MIMO) antennas and wireless communication devices using MIMO antennas.

BACKGROUND

Wireless communication devices, such as WIFI 802.11N and LTE compliant communication devices, are increasingly using MIMO antenna technology to provide increased data communication rates with decreased error rates. A MIMO antenna includes at least two antenna elements. The operational performance of a MIMO antenna depends upon obtaining sufficient decoupling and decorrelation between its antenna elements. It is therefore usually desirable to position the antenna elements far apart within a device and/or to use radiofrequency (RF) shielding therebetween while balancing its size and other design constraints.

In particular, most of the existing decoupling techniques suitable for mobile terminals focus on relatively high frequency bands, including the WLAN, DCS1800 and UMTS bands, whereas the isolation for low frequency bands below 1.0 GHz is typically worse than 6.0 dB. For low frequency bands, the chassi plays an important role in determining the mutual coupling among the antennas, since the chassis not only acts as a ground plane, but also as a radiator shared by the multiple antennas. Thus, the radiation patterns are modified by the chassi, so that the angle and polarization diversities are difficult to achieve. As a result, the achievable performance of the multiple antenna terminals in MIMO applications may be degraded.

SUMMARY

Some embodiments of the present inventive concept provide an antenna including a chassi and first and second radiating elements coupled to the chassi. The first radiating element is configured to amplify excitation of the chassi and the second radiating element is configured to reduce excitation of the chassi so as to reduce mutual coupling in the antenna system.

In further embodiments, the first radiating element may be included in a folded monopole antenna and the second radiating element may be included in a loop antenna.

In still further embodiments, the folded monopole antenna may include the first radiating element and a strip line on the chassi, the monopole strip being coupled to the first radiating element. The loop antenna may include the second radiating element; a loop feeding line on the chassi, the loop feeding line being coupled to the second radiating element; and an element configured to tune a resonant frequency of the loop antenna.

In some embodiments, the second radiating element may be one of a semi-square loop, a meander line loop and a circular loop.

In further embodiments, the loop feeding line is one of a semi-square loop, an L-shaped feed and a T-shaped feed. When the loop feeding line is a semi-square loop, a matching condition of the loop feeding line may be tuned by varying dimensions of the semi-square loop.

In still further embodiments, the element configured to tune the resonant frequency of the loop antenna may be an interdigital capacitor. If the element used to tune the resonant frequency of the loop antenna is an interdigtial capacitor, the interdigital capacitor may be configured to tune the resonant frequency of the loop antenna by changing an arm length of the interdigital capacitor and/or a distance between arms of the interdigital capacitor.

In some embodiments, the element configured to tune a resonant frequency of the loop antenna is at least one of a variable capacitor and a varactor diode.

In further embodiments, the loop antenna may further include a hollow plastic carrier configured to support the loop antenna.

In still further embodiments, the folded monopole antenna is located at a first end of the chassi and the loop antenna is located at a second end of the chassi, the second end of the chassi being opposite the first end of the chassi.

In some embodiments, the folded monopole antenna and the loop antenna are co-located at a same end of the chassi.

In further embodiments, the antenna system is included in a wireless communications device.

Still further embodiments of the present inventive concept provide a co-located multiple input multiple output (MIMO) antenna comprising: a chassi; a folded monopole antenna coupled to a first end of the chassi, the folded monopole antenna comprising: a first radiating element on the chassi; and a strip line on the chassi, the monopole strip being coupled to the first radiating element; and a loop antenna coupled to the first end of the chassi such that the folded monopole antenna and the loop antenna are co-located at the first end of the chassi, the loop antenna comprising: a second radiating element on the chassi; a loop feeding line on the chassi, the loop feeding line being coupled to the second radiating element; and an element configured to tune a resonant frequency of the loop antenna.

Some embodiments of the present inventive concept provide methods of controlling mutual coupling in an antenna system provided on a chassi. The method includes providing a first radiating element coupled to a first end of the chassi, the first radiating element configured to amplify excitation of the chassi; and providing a second radiating element coupled to a second end of the chassi, the second radiating element configured to reduce excitation of the chassi.

In further embodiments, the first and second ends of the chassi may be a same end of the chassi such that the first and second radiating elements are co-located at a same end of the chassi.

Other antennas, communications devices, and/or methods according to embodiments of the inventive concept will be or become apparent to one with skill in the art upon review of the following drawings and detailed description. It is intended that all such additional antennas, communications devices, and/or methods be included within this description, be within the scope of the present inventive concept, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the inventive concept and are incorporated in and constitute a part of this application, illustrate certain embodiment(s) of the inventive concept. In the drawings.

DETAILED DESCRIPTION OF EMBODIMENTS

Figure 1:
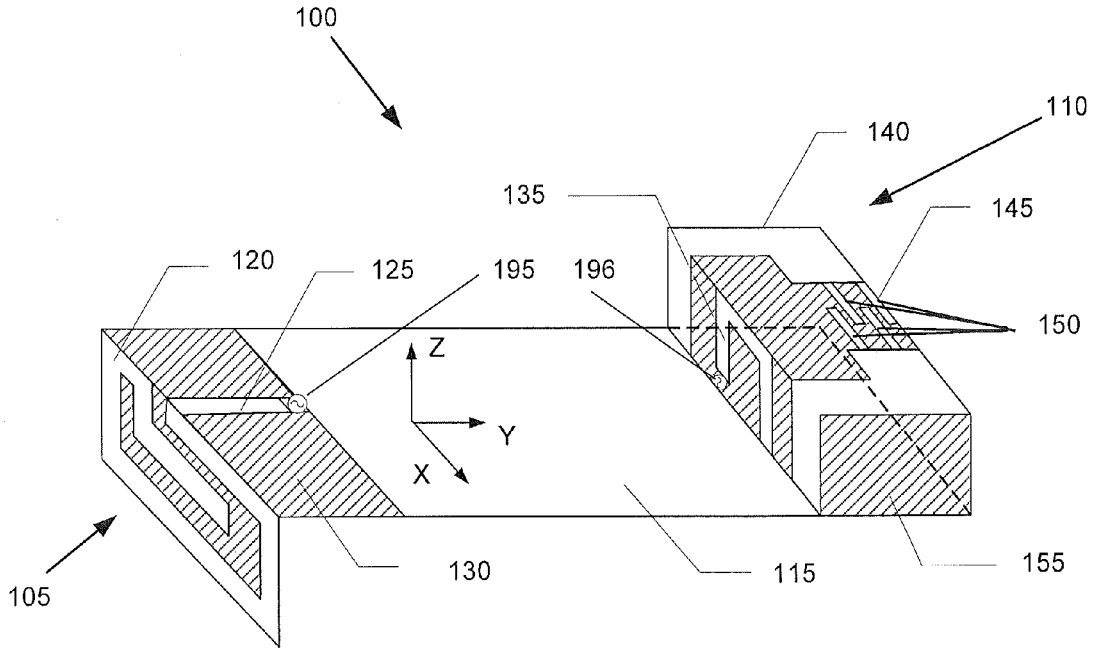
FIG. 1 is a diagram illustrating a multiple antenna system according to some embodiments of the present inventive concept.

The inventive concept will now be described more fully hereinafter with reference to the accompanying drawings, in which embodiments of the inventive concept are shown. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the inventive concept are described herein with reference to schematic illustrations of idealized embodiments of the inventive concept. As such, variations from the shapes and relative sizes of the illustrations as a result, for example, of manufacturing techniques and/or tolerances, are to be expected. Thus, embodiments of the inventive concept should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the inventive concept.

For purposes of illustration and explanation only, various embodiments of the present inventive concept are described herein in the context of a wireless communication terminal ("wireless terminal" or "terminal") that includes a an antenna system, for example, a MIMO antenna, that is configured to transmit and receive RF signals in two or more frequency bands. The antenna may be configured, for example, to transmit/receive RF communication signals in the frequency ranges used for cellular communications (e.g., cellular voice and/or data communications), WLAN communications, and/or TransferJet communications, etc.

As discussed above, design of multiple antennas for use in, for example, compact mobile terminals can be a significant challenge, especially for low frequency bands of, for example, below about 1.0 GHz. In particular, the chassis of these antennas is typically a shared radiator of the antennas, thus, at low frequency bands the mutual coupling among the antennas may be very strong, which degrades antenna performance, such as correlation, diversity gain, capacity and the like.

Accordingly, some embodiments of the present inventive concept, provide an antenna system that addresses the strong mutual coupling for two-antennas sharing a common radiating chassi. For example, in some embodiments, a magnetic-field-responsive loop antenna is used as a diversity antenna, in order to reduce shared chassis radiation with the main antenna, for example, a folded monopole antenna. Furthermore, in some embodiments, the two antennas, i.e., the magnetic loop antenna and the folded monopole, can be co-located at one edge of the chassis, which may greatly reduce the necessary space for antenna implementation on the chassi. Thus, some embodiments of the present inventive concept can provide high isolation, for example, of above about 20 dB; high efficiency, for example, of above about 80% for both antennas; and good diversity gains, for example, of above about 9.5 dB for switched combining at 1.0% probability for frequencies less than 1.0 GHz as will be discussed further below with respect to FIGS. 1 through 9 below.

Referring first to FIG. 1, a diagram of an exemplary antenna system 100 configured in accordance with some embodiments of the present inventive concept will be discussed. As illustrated in FIG. 1, the antenna system 100, for example, a multiple input multiple output (MIMO) antenna, includes a folded monopole antenna 105 as a main antenna and a magnetic field responsive loop antenna 110 as a diversity antenna. The folded monopole antenna 105 and the magnetic loop antenna 110 share a chassi 115. As illustrated, in embodiments of FIG. 1, the two antennas 105 and 110 are spaced apart and are located at opposite ends of the chassi 115. In some embodiments, the chassi 115, or ground plane, of the antenna system 100, is made of copper. In some embodiments, the chassi may be 100 mm×40 mm, or the typical dimensions of a chassi in a candy-bar type mobile phone. However, it will be understood that chassis according to embodiments of the present inventive concept are not limited to these exemplary dimensions.

As further illustrated in FIG. 1, the folded monopole antenna 105 includes a radiator, the radiator including 120 and 125, and a port 195. The radiator 120 and 125 is implemented on a printed circuit board (PCB) 130. In some embodiments, the PCB 130 can be a thin copper layer on a Teflon laminate substrate. In some embodiments, the substrate may have a permittivity of 2.45, a loss tangent of 0.003 and a thickness of about 0.8 mm. The portion of the radiator (strip line) 125 of the folded monopole antenna 105 may be printed on the Teflon laminate substrate 130.

The loop antenna 110 includes a feeding line 135, a radiator 140, an interdigital capacitor 145 and a port 196. The feeding line 135 of the magnetic field responsive loop antenna 110 is illustrated in FIG. 1 as being a semi-square ring loop. Thus, a matching condition can be tuned by, for example, varying the dimensions of the semi-square loop feeding line 135. However, it will be understood that embodiments of the present invention are not limited to the feeding line 135 configuration illustrated in FIG. 1. For example, as illustrated respectively in FIGS. 7A and 7B, the feeding line 135 of the loop antenna 110 can be an 'L-shaped' feed 735' or a 'T-shaped' feed 735" as long as the impedance matching is well achieved.

Figure 8A:
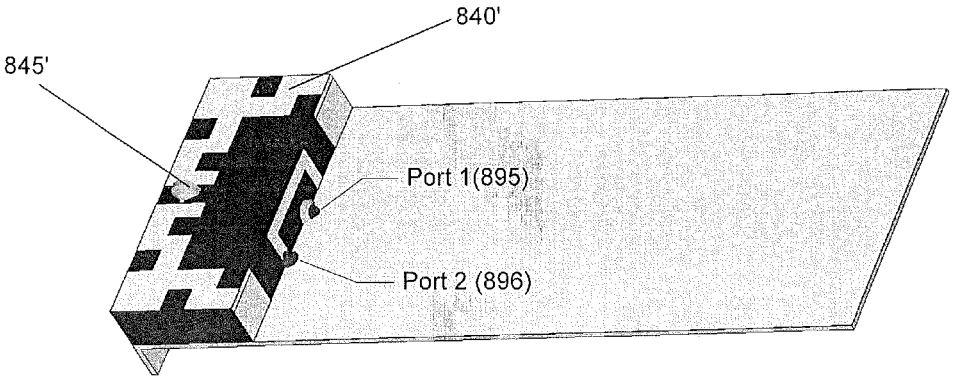
FIGS. 8A through 8C are diagrams illustrating various embodiments of the radiating loop according to some embodiments of the present inventive concept.
Figure 8B:
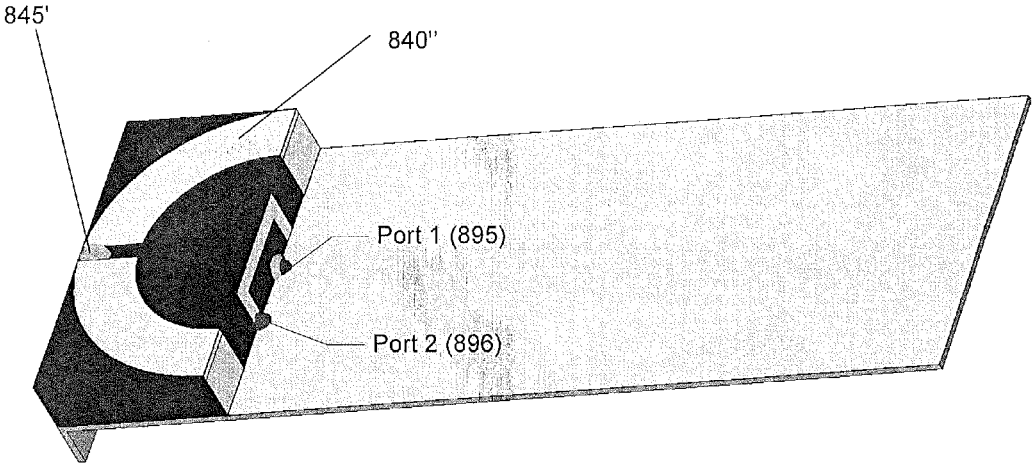
Figure 8C:
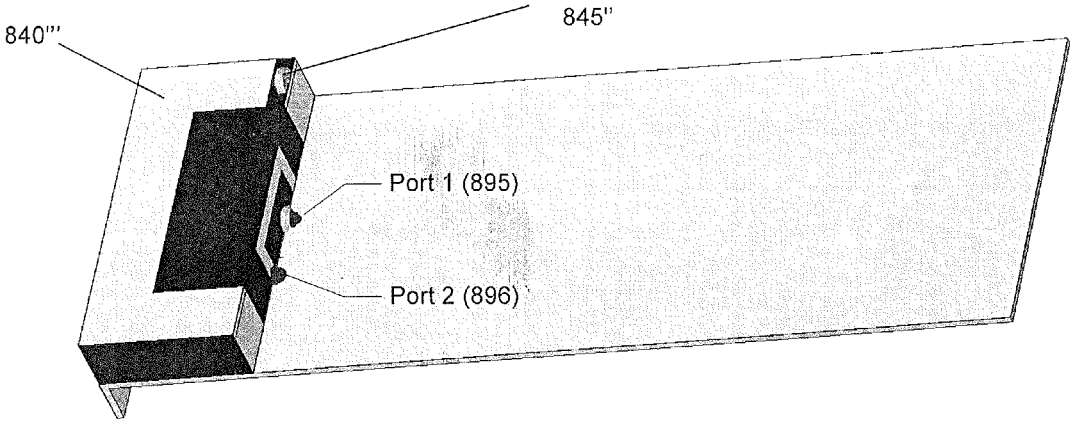

Referring again to FIG. 1, the radiator 140 of the loop antenna is also a semi-square ring loop of larger dimensions than the feeding loop 135. However, it will be understood that embodiments of the present invention are not limited to the radiator 140 configuration illustrated in FIG. 1. For example, as illustrated respectively in FIGS. 8A and 8B, the radiator of the loop antenna 110 can be a meander line loop 840' or a circular loop 840". Furthermore, the position of the opening of the loop does not need to be in the center of the loop, it can be at any part of the loop, as illustrated in FIG. 8C, 840", however, it would need to be re-matched.

Referring again to FIG. 1, a resonant frequency of the loop antenna 110 can be tuned by, for example, changing a length of an arm 150 of the interdigital capacitor 145 and/or a distance between the arms 150 of the interdigital capacitor 145. It will be understood that these adjustments to the arms 150 of the interdigital capacitor 145 would be performed during manufacturing of the antenna system 100. Although embodiments of the present inventive concept are illustrated in FIG. 1 as including an interdigital capacitor 145, embodiments of the present inventive concept are not limited to this configuration. For example, as illustrated in FIGS. 7A-8C, the interdigital capacitor could be replaced by another element 745', 745", 845' and 845", for example, a MEMS capacitor or a varactor diode without departing from the scope of the present inventive concept. These embodiments may allow for tuning after the antenna system has been fabricated, i.e. during operation.

Referring again to FIG. 1, the antenna system 100 of FIG. 1 further includes a hollow carrier 155 made of, for example, plastic. This hollow carrier 155 may be used to support the loop antenna 110. During fabrication of the mobile terminal and/or compact terminal, a speaker and/or camera of the mobile terminal may be placed inside the hollow carrier 155 of the antenna system 100 to conserve space and allow the size of the terminal to be decreased.

As discussed above, an antenna system having a monopole antenna 105 configured to amplify excitation of the chassi 115 and a loop antenna 110 to reduce excitation of the chassi 115 is provided in accordance with some embodiments may reduce the problem of mutual coupling among antennas on a small chassis at low frequency bands. By taking advantage of polarization diversity through synthesizing orthogonal radiation modes, i.e., the dipole mode and small loop mode, an isolation of above about 20 dB can be achieved. The efficiencies of both antennas may be greater than about 80% at the center frequency. As discussed above, to compensate for the narrow bandwidth of the magnetic loop, the loop can be made frequency tunable with a variable capacitor, without affecting the good performance of the antenna system. As will be discussed further below with respect to FIG. 5, in some embodiments, the two antennas can also be co-located at a same side of the chassi 115 to save implementation space on the chassis of a mobile terminal. Accordingly, embodiments discussed herein can be used to address the mutual coupling problem between closely packed MIMO antennas operating at low frequencies, for example, the LTE 700 MHz band.

Figure 2:
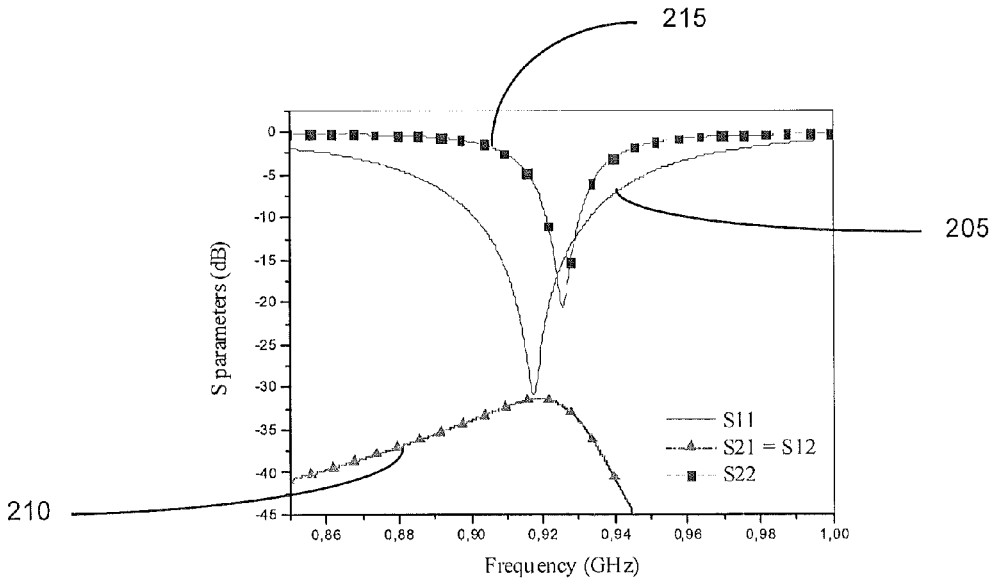
FIG. 2 is a graph of antenna scattering parameters ($S_{11}$, $S_{22}$ and $S_{21}$) versus frequency that may be generated by an operational simulation of the antenna system of FIG. 1 according to some embodiments of the present inventive concept.
Figure 3:
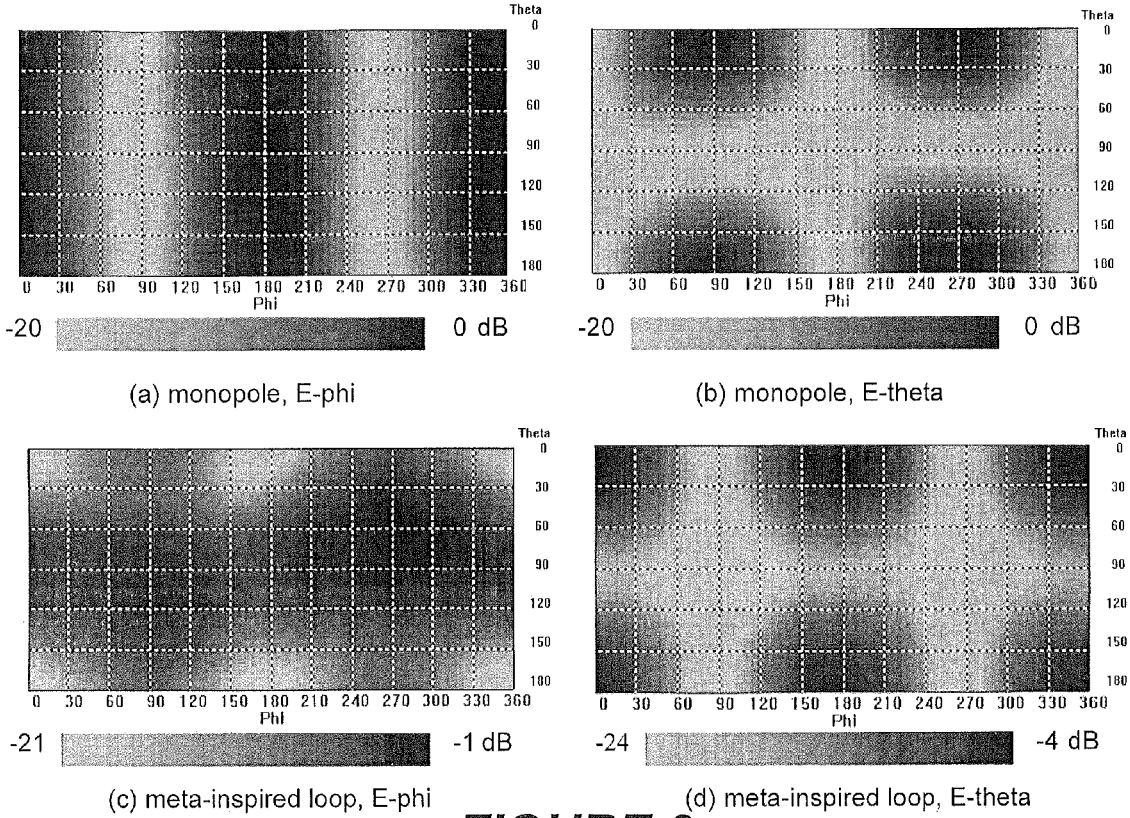
FIGS. 3A through 3D are graphs illustrating simulated radiation patterns of the antenna system of FIG. 1 according to some embodiments of the present inventive concept.

Referring now to FIG. 2, a graph of antenna scattering parameters ($S_{11}$, $S_{22}$, $S_{12}$ and $S_{21}$) versus frequency that may be generated by an operational simulation of the antenna system of FIG. 1 will be discussed. The folded monopole antenna 105 is represented as antenna 1 and the loop antenna is represented as antenna 2. $S_{11}$ indicated by curve 205 represents radiating element 120 of the folded monopole antenna 105 of FIG. 1 and is a measure of how much power (dB) is reflected back to transceiver circuitry connected thereto. Similarly, $S_{22}$ indicated by curve 215 represents radiating element 140 of the loop antenna 110 of FIG. 1 and is a measure of how much power (dB) is reflected back to transceiver circuitry connected thereto. $S_{21}=S_{12}$ (indicated by Curve 210) represents the coupling that occurs between the antenna feed ports of the radiating elements 120 and 140. As illustrated in FIG. 2, a good isolation of above 30 dB is achieved using the antenna system 100 of FIG. 1 over the operating frequency.

Referring now to FIGS. 3A through 3D, graphs illustrating the simulated far field radiation patterns of the antennas in the antenna system of FIG. 1 will be discussed. As illustrated, the E-theta and E-phi components are shown separately. Both polarization and angle diversities can be observed in FIG. 3. Good diversity performance contributes to the high port isolation and low correlation (0.003 at the center frequency). The simulated diversity gain is 9.5 dB at 1.0% probability, assuming the use of switched combining.

The only drawback for the multiple antenna system 100 of FIG. 1 is a relatively narrow bandwidth of the compact loop antenna 110. However, this can be compensated by frequency tuning the compact loop antenna 110 using a variable capacitor, for example, a tunable MEMS capacitor, a varactor diode and the like as discussed above. Thus, the variable capacitor may be used to replace the interdigital capacitor 145 on the radiating loop 140 as illustrated in FIG. 1.

Figure 4:
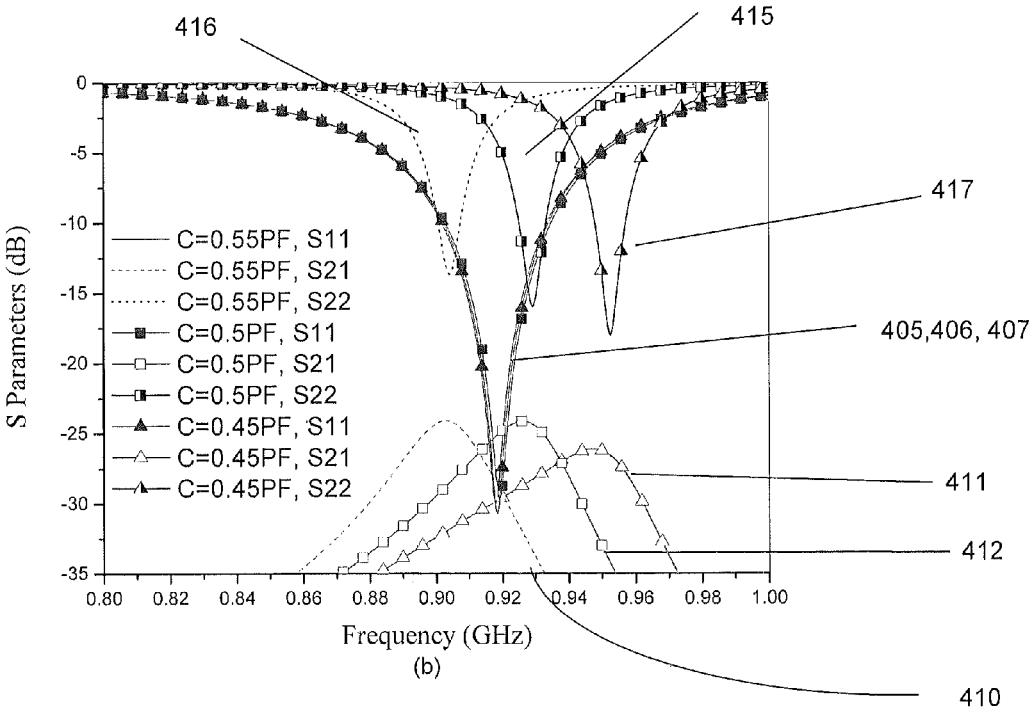
FIG. 4 is a graph of antenna scattering parameters ($S_{11}$, $S_{22}$ and $S_{21}$) versus frequency that may be generated by an operational simulation of the antenna system of FIG. 1 for different values of a capacitor according to some embodiments of the present inventive concept.

Referring now to FIG. 4, a graph illustrating S ($S_{11}$, $S_{22}$, $S_{21}$) parameters for an antenna system having different values of the capacitor will be discussed. As discussed above, the folded monopole antenna 105 is represented as antenna 1 and the loop antenna 110 is represented as antenna 2. The graph illustrates S values ($S_{11}$, $S_{22}$, $S_{21}$) for capacitor values of 0.55 PF, 0.5 PF and 0.45 PF. In particular, $S_{11}$, 0.55 PF; $S_{11}$, 0.5 PF; and $S_{11}$, 0.45 PF are indicated by curves 405, 406 and 407, respectively. $S_{21}$, 0.55PF; $S_{21}$, 0.5 PF; and $S_{21}$, 0.45 PF are indicated by curves 410, 411 and 412, respectively. $S_{22}$, 0.55 PF; $S_{22}$, 0.5 PF; and $S_{22}$, 0.45 PF are indicated by curves 415, 416 and 417, respectively. As illustrated in FIG. 4, the resonant frequency of the magnetic loop varies with the value of the capacitor. Thus, by using different capacitor values between 0.45 PF and 0.55 PF, it is well matched (S11<−10 dB) within an operating band from 0.9 GHz to 0.96 GHz, without any additional matching network. The performance of the monopole antenna 105 is not influenced during the tuning of the loop antenna 110, which makes the frequency tuning easier to achieve.

Figure 5:
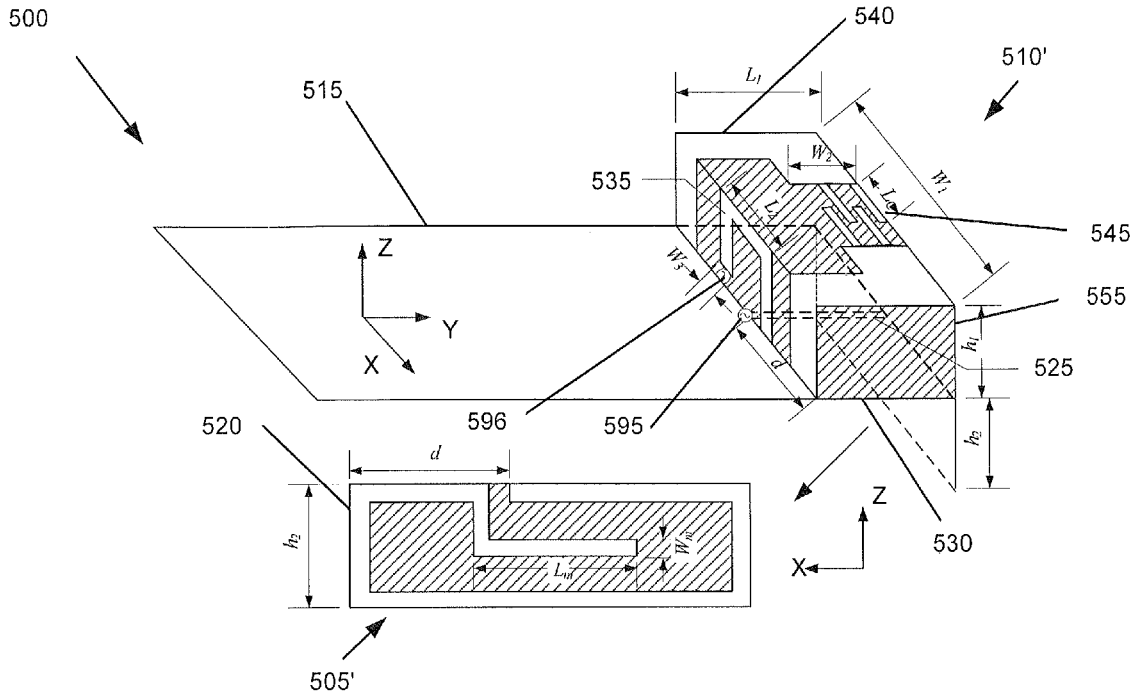
FIG. 5 is a diagram illustrating a co-located multiple antenna system according to some embodiments of the present inventive concept.

Referring now to FIG. 5, a diagram of a co-located antenna system 500 in accordance with some embodiments of the present inventive concept will be discussed. In embodiments illustrated in FIG. 5, to further save the implementation space on the PCB 515, the two antennas 505' and 510' can be co-located at one end of the PCB 515. Like elements of FIG. 5 are labeled with like reference numerals of FIG. 1. Thus, details with respect to each of the elements will not be discussed further herein.

As illustrated in FIG. 5, dimensions of the various aspect of the co-located antenna system 500 are provided. Exemplary measurements are provided below, however, it will be understood that embodiments of the present inventive concept are not limited by these exemplary dimensions. The dimensions according to some embodiments of the antenna system 500 may be: $L_1$=17 mm, $W_1$=40 mm, $L_2$=15 mm, $W_2$=7 mm, $W_3$=2 mm, $h_1$=6 mm, $h_2$=6 mm, $L_c$=9.85 mm, d=17.5 mm, $L_m$=14.5 mm, $W_m$=1 mm.

Figure 6:
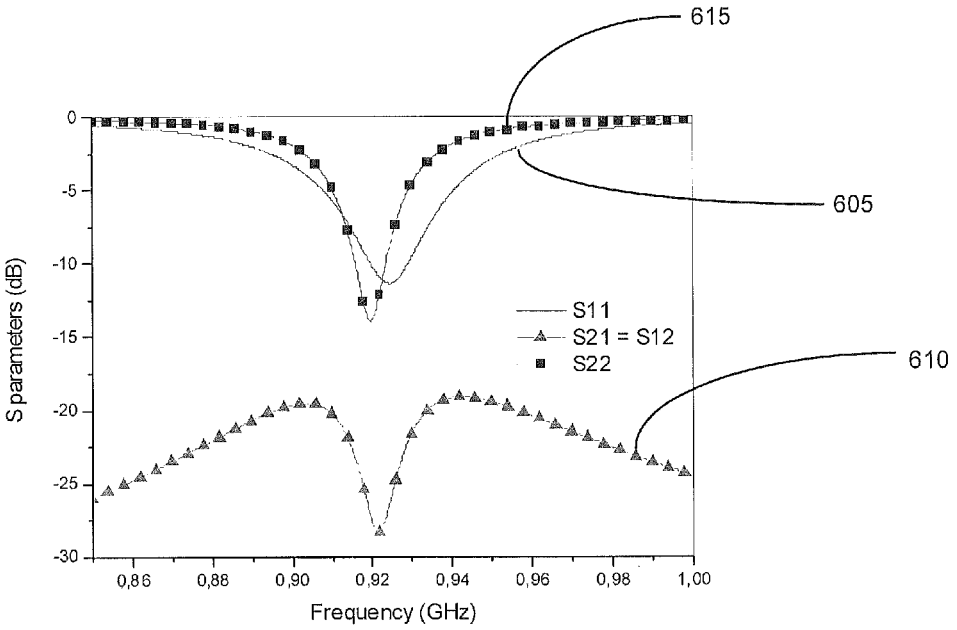
FIG. 6 is a graph of antenna scattering parameters ($S_{11}$, $S_{22}$ and $S_{21}$) versus frequency that may be generated by an operational simulation of the antenna system of FIG. 5 according to some embodiments of the present inventive concept.
Figure 7A:
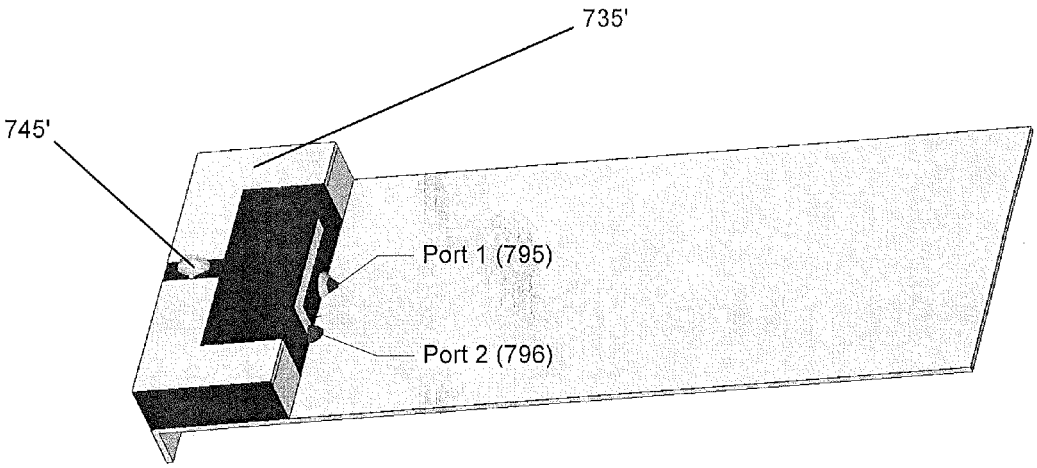
FIGS. 7A and 7B are diagrams illustrating various embodiments of the feeding portion of the antenna according to some embodiments of the present inventive concept.
Figure 7B:
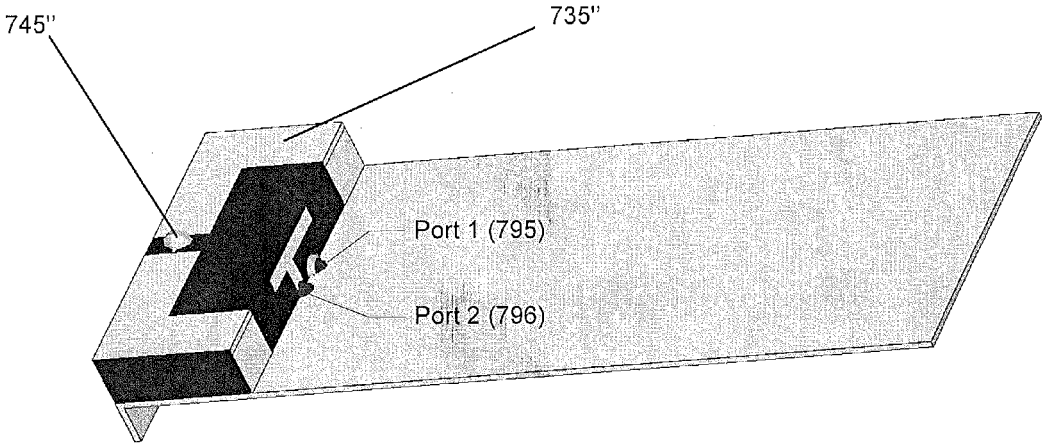

Referring now to FIG. 6, a graph of antenna scattering parameters ($S_{11}$, $S_{22}$, $S_{12}$ and $S_{21}$) versus frequency that may be generated by an operational simulation of the antenna system of FIG. 5 will be discussed. The folded monopole antenna 505' is represented as antenna 1 and the loop antenna 510' is represented as antenna 2. $S_{11}$ indicated by curve 605 represents radiating element 520 of the folded monopole antenna 505' of FIG. 5 and is a measure of how much power (dB) is reflected back to transceiver circuitry connected thereto. Similarly, $S_{22}$ indicated by curve 615 represents radiating element 540 of the loop antenna 510' of FIG. 5 and is a measure of how much power (dB) is reflected back to transceiver circuitry connected thereto. $S_{21}=S_{12}$ (indicated by Curve 610) represents the coupling that occurs between the antenna feed ports of the radiating elements 520 and 540. As illustrated by the graph of FIG. 6, by tuning the location of the strip line 525 of the monopole antenna 505', a null in isolation can be achieved at the resonant frequency. The radiation patterns for both antennas are similar to those of the antenna system of FIG. 1. The efficiencies may be about 74.7% and 75.7%, respectively, for the monopole antenna 505' and the loop antenna 510'.

Figure 9:
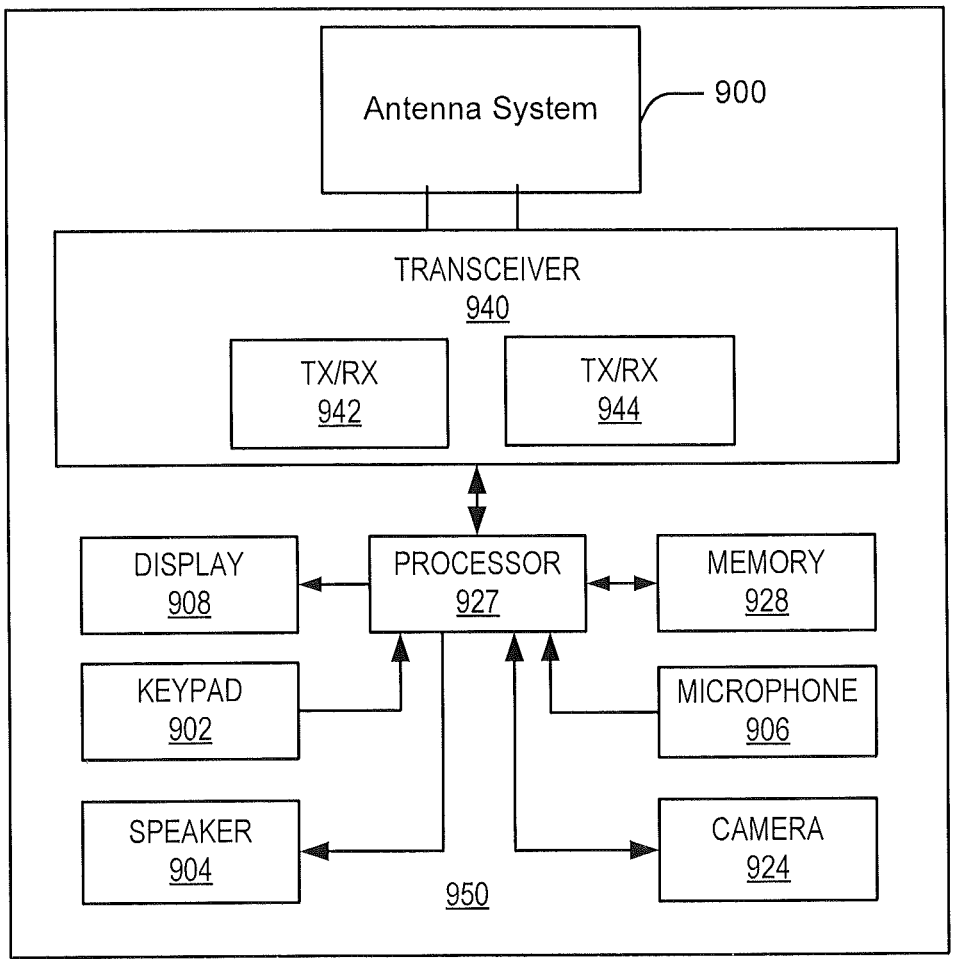
FIG. 9 is a block diagram of some electronic components, including an antenna system, of a wireless communication terminal in accordance with some embodiments of the present inventive concept.

Referring now to FIG. 9, a block diagram of a wireless communication terminal 900 that includes an antenna system 100, 500 in accordance with some embodiments of the present inventive concept will be discussed. As illustrated in FIG. 9, the terminal 950 includes an antenna system 900, a transceiver 940, a processor 927, and can further include a conventional display 908, keypad 902, speaker 904, mass memory 928, microphone 906, and/or camera 924, one or more of which may be electrically grounded to the same ground plane (e.g., ground plane 115 of FIG. 1 or 515 of FIG. 5) as the antenna 900. The antenna 900 may be structurally configured as shown for the antenna system 100 of FIG. 1 or co-located antenna system 500 of FIG. 5, or may be configured in accordance with various other embodiments of the present inventive concept.

The transceiver 940 may include transmit/receive circuitry (TX/RX) that provides separate communication paths for supplying/receiving RF signals to different radiating elements of the antenna system 900 via their respective RF feeds. Accordingly, when the antenna system 900 includes two antenna elements, such as shown in FIGS. 1 and 5, the transceiver 940 may include two transmit/receive circuits 942,944 connected to different ones of the antenna elements via the respective RF feeds 125/525 and 135/535.

The transceiver 940 in operational cooperation with the processor 927 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the inventive concept.

It will be appreciated that certain characteristics of the components of the antennas systems illustrated in FIGS. 1 and 5 such as, for example, the relative widths, conductive lengths, and/or shapes of the radiating elements, and/or other elements of the antennas may vary within the scope of the present inventive concept. Thus, many variations and modifications can be made to the embodiments without substantially departing from the principles of the present inventive concept. All such variations and modifications are intended to be included herein within the scope of the present inventive concept, as set forth in the following claims.

What is claimed is:

1. An antenna system comprising:

a chassi;

a first radiating element coupled to the chassi, the first radiating element configured to amplify excitation of the chassi; and a second radiating element coupled to the chassi, the second radiating element configured to reduce excitation of the chassi so as to reduce mutual coupling in the antenna system, wherein the first radiating element is included in a folded monopole antenna;

wherein the second radiating element is included in a loop antenna;

wherein the folded monopole antenna comprises:

the first radiating element; and a strip line on the chassi, the strip line being coupled to the first radiating element; and wherein the loop antenna comprises:

the second radiating element;

a loop feeding line on the chassi, the loop feeding line being coupled to the second radiating element; and an element configured to tune a resonant frequency of the loop antenna.

2. The antenna system of claim 1, wherein the second radiating element comprises one of a semi-square loop, a meander line loop and a circular loop.

3. The antenna system of claim 1, wherein the loop feeding line is one of a semi-square loop, an L-shaped feed and a T-shaped feed.

4. The antenna system of claim 1, wherein the loop feeding line is a semi-square loop and wherein a matching condition of the loop feeding line is tuned by varying dimensions of the semi-square loop.

5. The antenna system of claim 1:

wherein the element configured to tune the resonant frequency of the loop antenna comprises an interdigital capacitor; and wherein the interdigital capacitor is configured to tune the resonant frequency of the loop antenna by changing an arm length of the interdigital capacitor and/or a distance between arms of the interdigital capacitor.

6. The antenna system of claim 1, wherein the element configured to tune a resonant frequency of the loop antenna comprises at least one of a variable capacitor and a varactor diode.

7. The antenna system of claim 1, wherein the loop antenna further comprises a hollow plastic carrier configured to support the loop antenna.

8. The antenna system of claim 1, wherein the folded monopole antenna is located at a first end of the chassi and wherein the loop antenna is located at a second end of the chassi, the second end of the chassi being opposite the first end of the chassi.

9. The antenna system of claim 1, wherein the folded monopole antenna and the loop antenna are co-located at a same end of the chassi.

10. The antenna system of claim 1 wherein the antenna system is included in a wireless communications device.

11. A co-located multiple input multiple output (MIMO) antenna comprising:

a chassi;

a folded monopole antenna coupled to a first end of the chassi, the folded monopole antenna comprising:

a first radiating element on the chassi; and a strip line on the chassi, the strip line being coupled to the first radiating element; and a loop antenna coupled to the first end of the chassi such that the folded monopole antenna and the loop antenna are co-located at the first end of the chassi, the loop antenna comprising:

a second radiating element on the chassi;

a loop feeding line on the chassi, the loop feeding line being coupled to the second radiating element; and an element configured to tune a resonant frequency of the loop antenna.

12. The co-located MIMO antenna of claim 11, wherein the second radiating element comprises one of a semi-square loop, a meander line loop and a circular loop.

13. The co-located MIMO antenna system of claim 11, wherein the loop feeding line is one of a semi-square loop, an L-shaped feed and a T-shaped feed.

14. The co-located MIMO antenna system of claim 11, wherein the loop feeding line is a semi-square loop and wherein a matching condition of the loop feeding line is tuned by varying dimensions of the semi-square loop.

15. The co-located MIMO antenna system of claim 11:

wherein the element configured to tune the resonant frequency of the loop antenna comprises an interdigital capacitor; and wherein the interdigital capacitor is configured to tune the resonant frequency of the loop antenna by changing an arm length of the interdigital capacitor and/or a distance between arms of the interdigital capacitor.

16. The co-located MIMO antenna system of claim 11, wherein the element configured to tune a resonant frequency of the loop antenna comprises at least one of a variable capacitor and a varactor diode.

* * * * *